US008434558B2

(12) United States Patent
Swanson et al.

(10) Patent No.: US 8,434,558 B2
(45) Date of Patent: May 7, 2013

(54) SYSTEM AND METHOD FOR CONTAINING BOREHOLE FLUID

(75) Inventors: Aaron R. Swanson, Houston, TX (US); James P. Dwyer, Conroe, TX (US); Todd J. Talbot, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 173 days.

(21) Appl. No.: 12/945,995

(22) Filed: Nov. 15, 2010

(65) Prior Publication Data

US 2012/0118580 A1 May 17, 2012

(51) Int. Cl.
*E21B 7/12* (2006.01)

(52) U.S. Cl.
USPC ..... 166/368; 166/367; 166/359; 166/342; 166/341

(58) Field of Classification Search ..... 166/368, 166/367, 364, 359, 342, 341
See application file for complete search history.

(56) References Cited

U.S. PATENT DOCUMENTS 3,325,190 A * 6/1967 Eckert et al. ..... 285/18
3,548,605 A * 12/1970 Armistead et al. ..... 405/60
3,643,447 A * 2/1972 Pogonowski ..... 405/210
3,664,136 A * 5/1972 Laval et al. ..... 405/60
3,701,549 A * 10/1972 Koomey et al. ..... 285/24
4,283,159 A * 8/1981 Johnson et al. ..... 405/60
4,290,714 A * 9/1981 Strange ..... 405/60
4,318,442 A * 3/1982 Lunde et al. ..... 166/357
4,324,505 A * 4/1982 Hammett ..... 405/60
4,358,218 A * 11/1982 Graham ..... 405/60
4,358,219 A * 11/1982 Burns ..... 405/60
4,365,912 A * 12/1982 Burns ..... 405/60
4,382,716 A * 5/1983 Miller ..... 405/60
4,395,157 A * 7/1983 Cunningham ..... 405/60
4,440,423 A * 4/1984 Pfeifler, II ..... 285/25
4,449,850 A * 5/1984 Cessou et al. ..... 405/60
4,456,071 A * 6/1984 Milgram ..... 166/356
4,500,151 A * 2/1985 Ayers ..... 439/586
4,626,132 A * 12/1986 Allen ..... 405/71
4,643,612 A * 2/1987 Bergeron ..... 405/60
4,741,395 A * 5/1988 Reed et al. ..... 166/81.1
5,050,680 A * 9/1991 Diehl et al. ..... 166/356
5,114,117 A * 5/1992 Appleford et al. ..... 251/149.9
5,150,751 A 9/1992 Burton et al.
5,351,753 A 10/1994 Golson
5,394,939 A 3/1995 Walker
6,062,312 A * 5/2000 Wilkins ..... 166/340

(Continued)

OTHER PUBLICATIONS

Notification of Transmittal of the International Search Report and the Written Opinion of the International Searching Authority, or the Declaration; PCT/US2011/050963; Apr. 10, 2011.

(Continued)

*Primary Examiner* — Thomas A Beach
*Assistant Examiner* — Aaron Lembo
(74) *Attorney, Agent, or Firm* — Cantor Colburn LLP

(57) ABSTRACT

A device for containing fluid flow from a borehole includes: a containment assembly including a body having a cavity configured to receive a leaking portion of a borehole termination structure extending from the borehole and surround the leaking portion, the cavity configured to be adapted to at least partially conform to a shape of at least one of the leaking portion and the borehole termination structure; and a flow control assembly configured to connect a fluid conduit in fluid communication with the containment assembly and direct downhole fluid into the fluid conduit.

16 Claims, 7 Drawing Sheets

U.S. PATENT DOCUMENTS

| | | | | |
|---|---|---|---|---|
| 6,609,853 | B1 * | 8/2003 | Guilmette | 405/67 |
| 6,719,059 | B2 * | 4/2004 | Dezen et al. | 166/368 |
| 6,817,417 | B2 * | 11/2004 | Blair et al. | 166/335 |
| 7,413,012 | B2 * | 8/2008 | Davila | 166/277 |
| 7,882,794 | B2 * | 2/2011 | Baylot et al. | 114/312 |
| 8,006,763 | B2 * | 8/2011 | Bath et al. | 166/338 |
| 8,186,443 | B2 * | 5/2012 | Wolinsky | 166/364 |
| 2004/0182567 | A1 | 9/2004 | Matthews | |
| 2006/0266523 | A1 * | 11/2006 | Lower | 166/346 |
| 2006/0289159 | A1 * | 12/2006 | Davila | 166/277 |
| 2011/0274493 | A1 * | 11/2011 | Cutts | 405/60 |
| 2011/0274496 | A1 * | 11/2011 | Dvorak | 405/64 |
| 2011/0286797 | A1 * | 11/2011 | Boyd | 405/60 |
| 2011/0315233 | A1 * | 12/2011 | Carter | 137/14 |
| 2011/0318106 | A1 * | 12/2011 | Gateff et al. | 405/60 |
| 2011/0318107 | A1 * | 12/2011 | Dighe | 405/63 |
| 2012/0051840 | A1 * | 3/2012 | Hatton | 405/60 |
| 2012/0051841 | A1 * | 3/2012 | Hatton et al. | 405/63 |
| 2012/0070231 | A1 * | 3/2012 | Al-Sharif | 405/60 |
| 2012/0087729 | A1 * | 4/2012 | Oesterberg et al. | 405/60 |
| 2012/0121335 | A1 * | 5/2012 | Fedotov et al. | 405/64 |
| 2012/0125623 | A1 * | 5/2012 | Cargol et al. | 166/344 |

OTHER PUBLICATIONS

Krauss,E T Al., Cap Slows Gulf Oil Leak as engineers Move cautiously, Jun. 5, 2010(May 12, 2010) [retrieved on Apr. 22, 2011]. Retrieved from the internet:,URL:http://www.nytimes.com/2010/06/06/us/06spill.html?_r=1.

Montgomery, et al. "Drilling Well Control Practices and Equipment Considerations for Deepwater Operations Plans". OTC 10895. 1999 Offshore Technology Conference held in Houston Texas, May 3-6, 1999. 8 pages.

* cited by examiner

SYSTEM AND METHOD FOR CONTAINING BOREHOLE FLUID

BACKGROUND OF THE INVENTION

Blowout prevention is a significant concern in hydrocarbon exploration and production. Blowouts generally refer to uncontrolled fluid or gas flow from an earth formation into a wellbore, which could potentially flow to the surface. Component failure and/or sudden flow of formation fluid, such as water, oil and/or gas, into the borehole (i.e., a kick) can result in large amounts of fluid and other materials to flow from a borehole unfettered into the environment. The unrestricted flow can have significant impacts on health, safety and the environment, as well causing loss of income either directly or by reduced or delayed production.

BRIEF DESCRIPTION OF THE INVENTION

A device for containing fluid flow from a borehole includes: a containment assembly including a body having a cavity configured to receive a leaking portion of a borehole termination structure extending from the borehole and surround the leaking portion, the cavity configured to be adapted to at least partially conform to a shape of at least one of the leaking portion and the borehole termination structure; and a flow control assembly configured to connect a fluid conduit in fluid communication with the containment assembly and direct downhole fluid into the fluid conduit.

A method for containing fluid flow from a borehole includes: disposing a downhole fluid containment device proximate to a borehole termination structure from which borehole fluid is leaking into an ambient environment; lowering the containment device so that a containment assembly receives at least a leaking portion of the borehole termination structure, the containment assembly including a body having a cavity configured to surround the leaking portion upon receiving the leaking portion; adapting the cavity to at least partially conform to a shape of at least one of the leaking portion and the borehole termination structure; and directing borehole fluid from the leaking portion through the hollow body to at least one discharge port in fluid communication with the ambient environment; and diverting the borehole fluid to a fluid conduit by connecting the fluid conduit in fluid communication with the containment assembly and closing the at least one discharge port.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Devices, systems and methods for containing and/or controlling fluid flow from a borehole are provided. Such devices and systems are used, in one embodiment, as response/service tools for containing a borehole and stopping or controlling fluid flow from the borehole after undesired fluid flow resulting from, for example, a blowout, wellhead failure and/or blowout preventer (BOP) failure. A method includes positioning a leaking well containment device on a damaged wellhead or other borehole termination structure and actuating the device to at least partially seal the leaking portion and control the flow of fluid therefrom. In one embodiment, the device includes a containment assembly having a cavity configured to receive at least a leaking portion of the wellhead and direct downhole fluid to a conduit. In one embodiment, the cavity is configured to be adapted to at least partially conform to a shape and/or size of the leaking portion and/or the wellhead. For example, the containment assembly may be actuated to engage the wellhead and change the shape of the cavity to at least partially conform to the leaking portion and/or wellhead. A flow control assembly is configured to connect the fluid conduit to the cavity and may include fluid ports configured to allow fluid to escape into the surrounding environment when the containment assembly is engaged to the borehole. In one embodiment, the fluid ports are configured to be closed to direct downhole fluid to the conduit after the containment assembly is engaged.

The devices and systems described herein may be used as an emergency response service tool to contain a flowing well after a blowout or damage to a blowout preventer, wellhead component or other borehole component that causes borehole fluid to leak from the borehole into the surrounding environment. The devices can be used to create a seal around the top of a damaged wellhead and capture fluid flowing therefrom. The fluid may then be, for example, temporarily contained until a more permanent solution can be applied and/or directed to other containment vessels.

Figure 1:
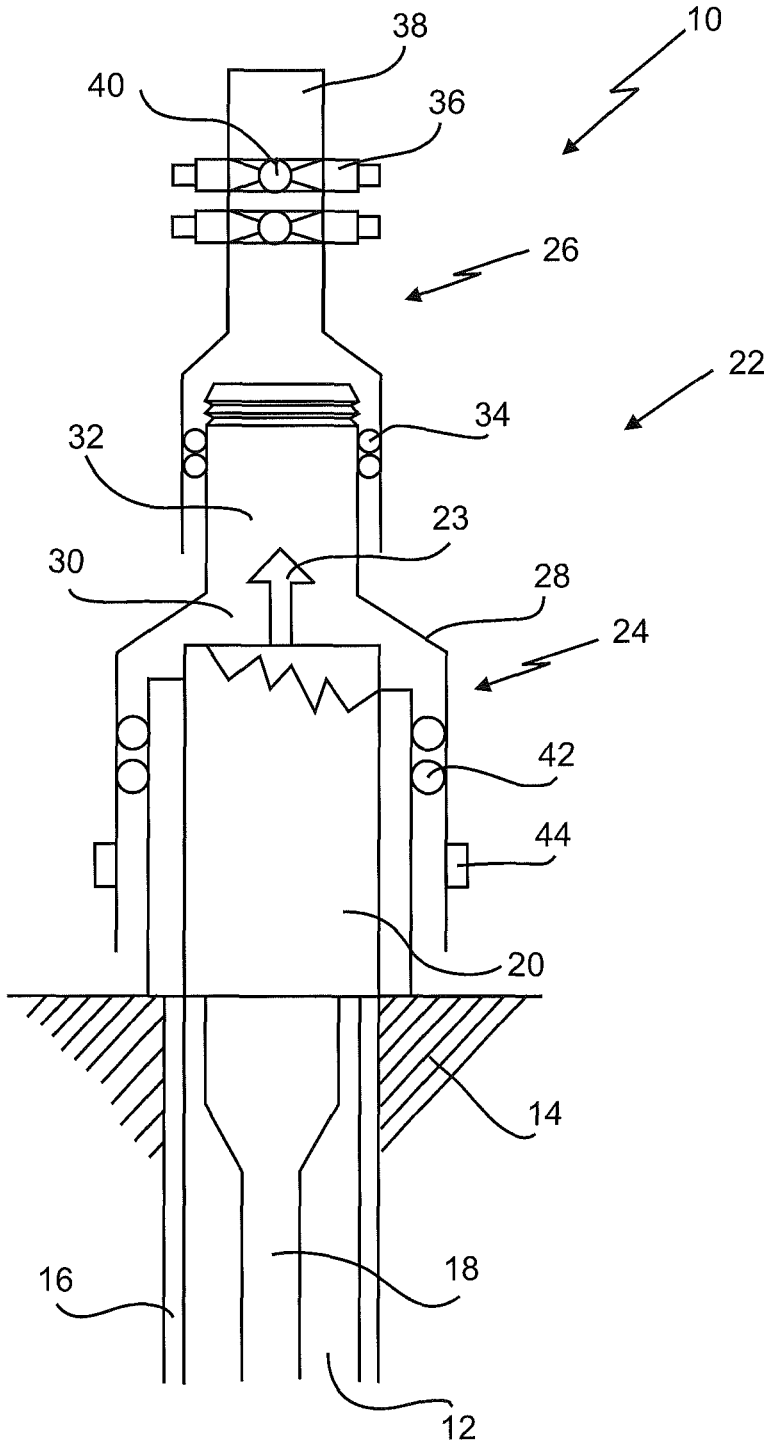
FIG. 1 is a side cross-sectional view of an embodiment of a borehole fluid containment/control device.

Referring to FIG. 1, an exemplary embodiment of a drilling, exploration, evaluation and/or production system 10 includes a borehole 12 that penetrates an earth formation 14. The borehole 12 may be an open hole or a cased hole that includes a casing 16. The borehole 12 may include a borehole string 18 such as a drill string or production string that includes various downhole tools or other components. A borehole termination structure such as a wellhead 20 is positioned at the surface of the borehole 12 and includes various components such as a blowout preventer (BOP), various valves, production fluid conduits and conduits for introducing downhole components. The wellhead 20 may be a subsea or surface structure. Examples of downhole components include the borehole string 12, downhole tools such as sensing tools and production tools, a bottomhole assembly (BHA) and a drilling assembly.

FIG. 1 also illustrates a fluid containment/control device 22, also referred to herein as a well capping device 22, that is configured to be lowered or otherwise disposed onto at least a portion of a damaged wellhead 20 and contain borehole fluid flowing out of the borehole 12. The well capping device 22 is configured to be positioned on or around a damaged or leaking portion to cap, contain or othwerwise control fluid flow from the borehole 12. A damaged or leaking portion may include any condition by which borehole fluid 23 can escape from the borehole 12 into the surrounding surface environment. Examples of damaged or leaking portions include breaches or openings in a tubular, blowout preventer (BOP), wellhead or other borehole component created by a blowout, wellhead breach, BOP failure or any other undesired fluid connection between the borehole 12 and the surrounding environment. The well capping device 22 may be utilized as part of an emergency response system and/or service to contain a flowing well after a blowout or damage to the wellhead 20.

The well capping device 22 includes an engagement assembly 24 configured to be disposed proximate to the wellhead 20 and removably secured to the wellhead so that at least the damaged or leaking portion of the wellhead 20 is surrounded by the engagement assembly 24. The well capping device 22 may also include a flow control assembly 26 configured to be separately actuated to at least substantially restrict fluid flow to within the well capping device 22 and direct fluid flow to a containment device or remote location.

In one embodiment, the engagement assembly 24 includes an at least partially hollow engagement body 28 that includes a cavity 30 configured to receive at least the damaged or leaking portion of the wellhead 20 therein. The cavity 30 has a cross-sectional area that has a shape and/or size configured to receive the damaged or leaking portion. The engagement assembly 24 also includes a connector 32 configured to be received by or otherwise operably connected to the flow control assembly 26. The connector 32 may include a threaded connection, friction fit, pin-box or other connection to secure the engagement assembly 24 to the flow control assembly 26 with an at least partially fluid-tight connection. One or more sealing components 34 such as gaskets or o-rings may be included with the connector 32 and/or the flow control assembly 26 to assist in creating the at least partially fluid-tight connection.

In one embodiment, the flow control assembly 26 and/or the engagement assembly 24 includes one or more fluid ports 36 that allow borehole fluid 23 to flow through the cavity 30 and/or the flow control assembly 26 to the surrounding environment to avoid causing a pressure buildup within the well capping device 22 that could hamper positioning and/or actuation of the engagement assembly 24. In one embodiment, the ports 36 are configured to be closed after the well capping device 22 is attached to or otherwise engaged with the wellhead 20 so that borehole fluid 23 is directed through the flow control assembly to, for example, a fluid conduit 38. The ports may be closed by any suitable mechanism, such as by one or more valves 40. The fluid conduit 38 may be disposed in fluid communication with a containment apparatus such as a surface tank, a containment ship or other seagoing vessel. Upon engagement of the well capping device 22 and closure of the ports 36, borehole fluid released from the borehole 12 is at least substantially contained and prevented from further release into the surrounding environment. Although the ports 36 are shown in FIG. 1 as being incorporated with the fluid control assembly 26, they are not so limited and may be incorporated at any suitable location, such as with the engagement assembly 24 (see, for example, FIGS. 5-6).

In one embodiment, the engagement body 28 includes a sealing and/or engagement mechanism configured to seal, grip or otherwise secure the well capping device 22 to the wellhead 20. For example, the engagement mechanism includes one or more mechanical seals 42 such as o-rings, gaskets or other sealing devices. The seals 42 may be made from a deformable, swellable and/or expandable material such as rubber, synthetic rubber, elastomers, thermoplastic materials, foams and shape memory materials. In one embodiment, the engagement body 28 includes one or more input ports 44 configured to inject a flowable sealing material into the cavity 30 after engagement with the wellhead 20 to facilitate providing an at least partially fluid tight seal between the wellhead 20 and the engagement body 28. Suitable flowable sealing materials include any swellable and/or flowable material such as a foam or a thermosetting polymer configured to provide a seal after injection. The injection ports 44 may be in fluid communication with a remote injection source or include an integrated supply of the injection material.

In one embodiment, the sealing materials include shape memory materials include materials such as Shape Memory Polymers (SMP) that have the ability to return from a deformed state to their original shape prior to deformation (referred to herein as a "remembered shape" or "activated shape") in response to a stimulus such as a temperature change, an electric or magnetic field, electromagnetic radiation, and a change in pH. Non-limiting examples of shape memory materials include Shape Memory Polymers (SMP), such as polyurethane or epoxy SMPs, which may have properties ranging from, for example, stable to biodegradable, soft to hard, and elastic to rigid, depending on the structural units that constitute the SMP. SMPs may also include thermoplastic and thermoset (covalently cross-linked) polymeric materials. SMPs may also be able to store multiple shapes in memory. In one embodiment, the shape memory material is configured to change from a deformed or "deployment shape" into a shape configured to prevent fluid flow between the wellhead 20 and the engagement body in response to a trigger, such as application of heat. The trigger may be, for example, a change in the chemical composition of the surrounding liquid (e.g., seawater to hydrocarbon fluid from the borehole), an injected chemical change, or application of a magnetic or electric field in the engagement body 28. Such triggers may be caused by changes in the fluid or changes in the engagement body 28 that are activated by a user or remote device.

In one embodiment, the engagement assembly 24 is configured to be adaptable to the specific type of damage and/or shape of the leaking or damaged portion of the wellhead 20. For example, the engagement assembly 24 is a modular component that may be used in conjunction with the well capping device 22. In this example, the well capping device 22 is part of a well capping system that includes a plurality of engagement assemblies 24, each of which have an engagement body 28 with different sizes, diameters and/or cross-sectional shapes. In this way, the system may be used to address a variety of types of damage and types of wellheads 20 by swapping out an engagement assembly 24 with an alternate assembly 24 having an engagement body 28 that is most adapted to the shape of the damaged portion of the wellhead 20.

Figure 2:
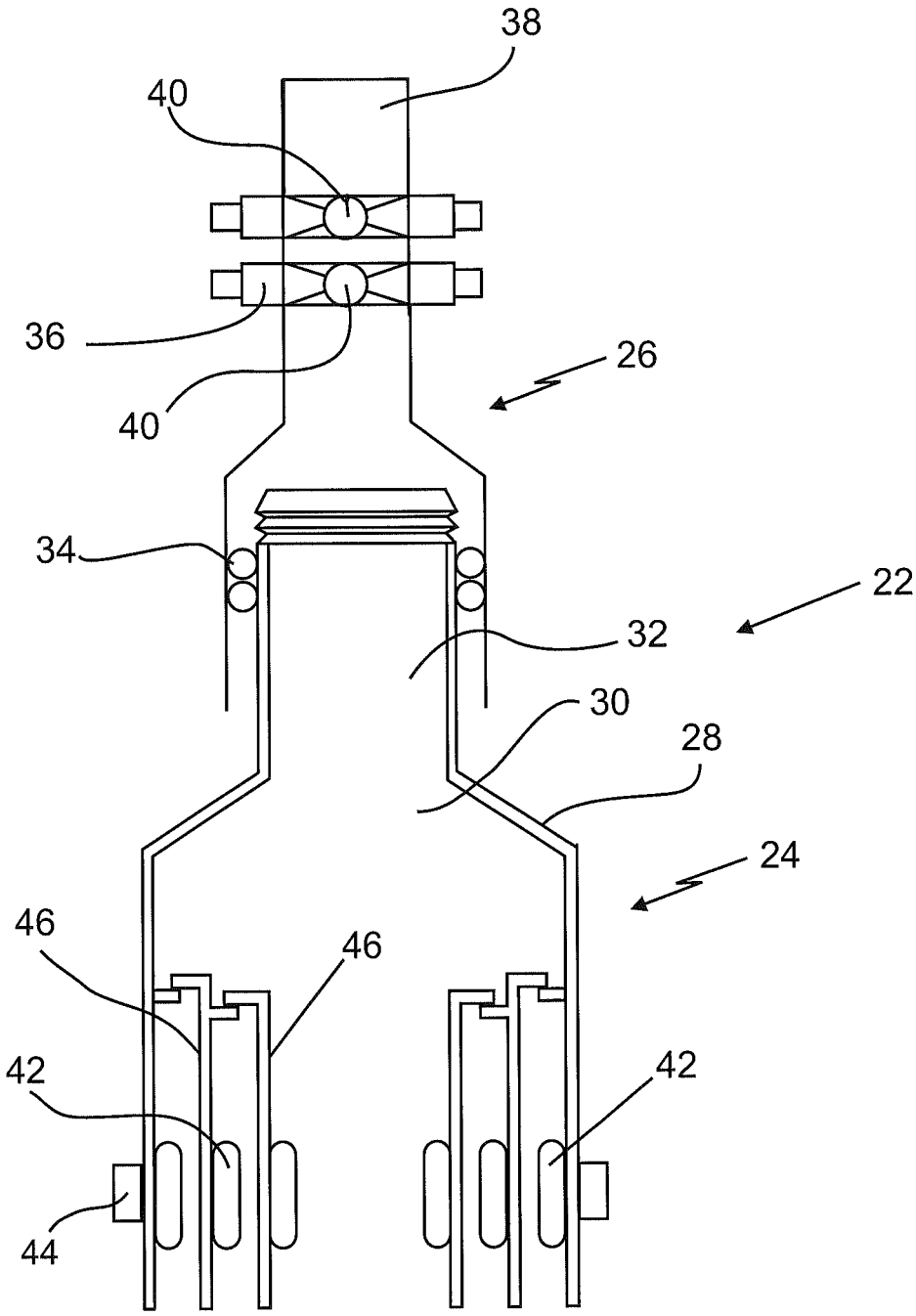
FIG. 2 is a side cross-sectional view of an embodiment of a borehole fluid containment/control device in an unengaged position.
Figure 3:
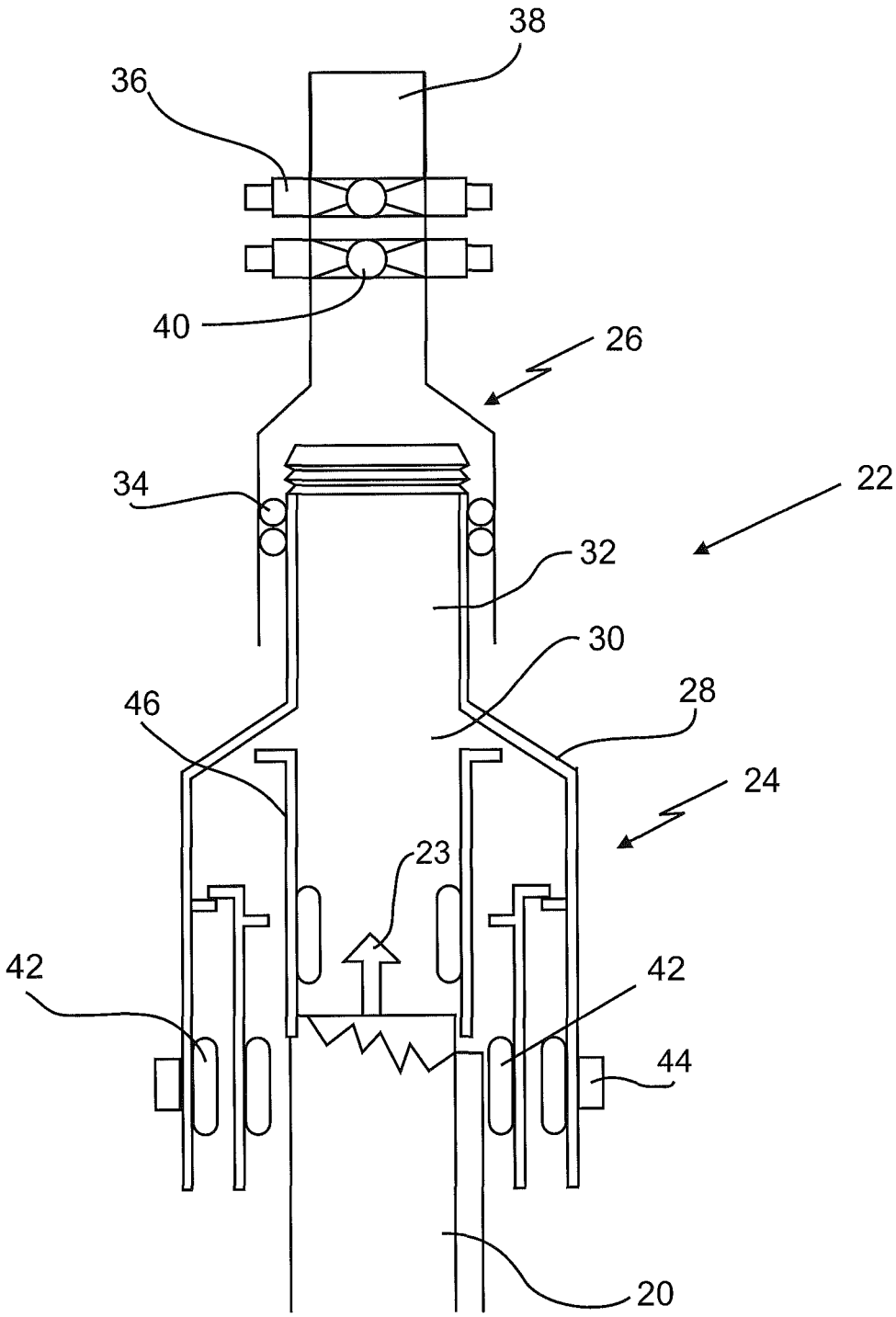
FIG. 3 is a side cross-sectional view of the borehole fluid containment/control device of FIG. 2 in an engaged position.
Figure 4:
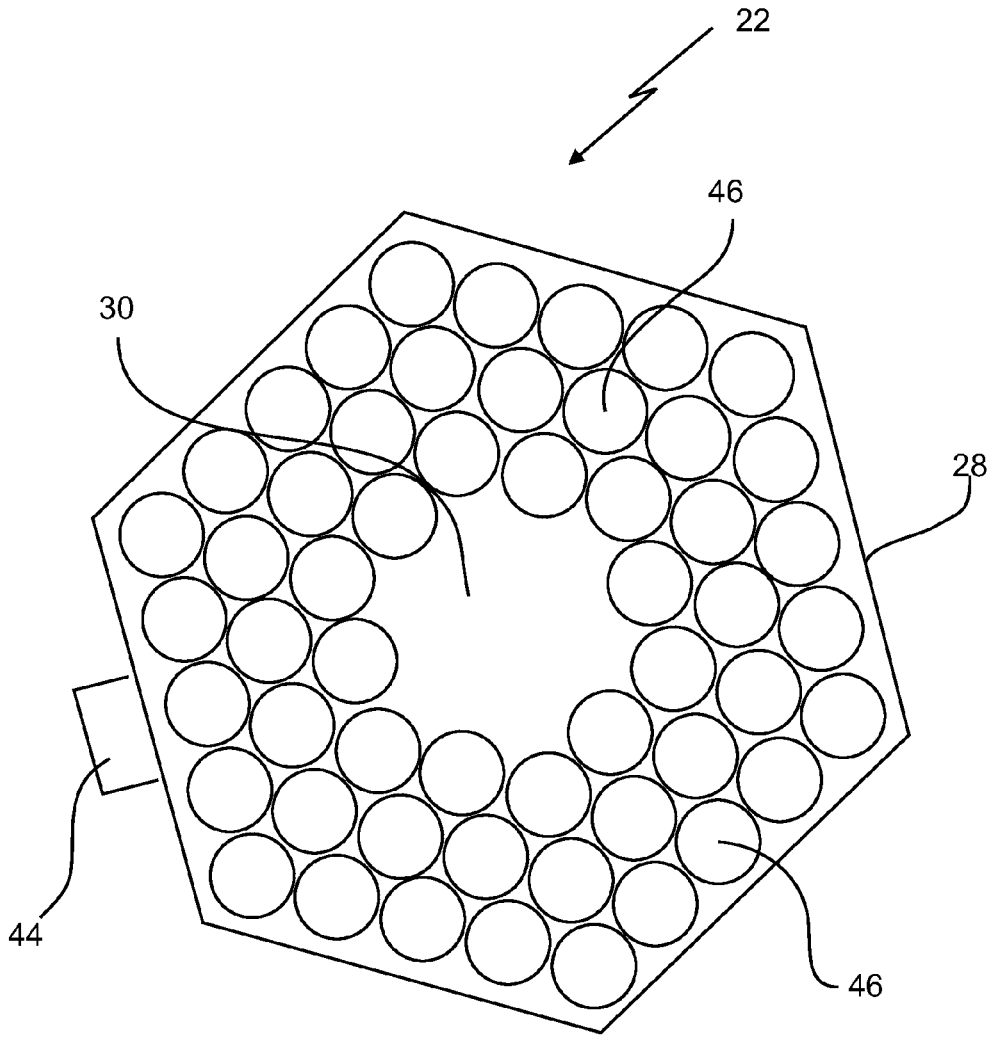
FIG. 4 is an axial cross-sectional view of an embodiment of a borehole fluid containment/control device.

Referring to FIGS. 2-4, in one embodiment, the engagement assembly 24 includes one or more movable members 46 that are configured to retract in response to contact with the wellhead 20 when the well capping device 22 is deployed around the wellhead 20. An example is shown in FIGS. 2 and 3, in which the engagement assembly 24 is shown in an undeployed or unengaged position in FIG. 2 and a deployed or engaged position in FIG. 3. In this example, the movable members 46 are concentric members 46 configured to retract as the well capping device 22 is deployed, so that only the members 46 that have a shape that can surround the engaged wellhead portion remain in a lowered position. In this way, the engagement body 28 can adapt the cavity 30 to the particular size and/or shape of the engaged wellhead portion. In one embodiment, the interior of the engagement body 28 and/or one or more members 46 may include a sealing mechanism 42 that can be actuated to provide a seal around the wellhead. Examples of such mechanisms 42 include injection ports 44, and deformable materials such as inflatable, swellable or expandable materials as described above. Although the engagement body 28 and the movable members 46 are shown in FIGS. 2-3 as being generally cylindrical, they are not so limited and may have any desired cross-sectional shape, such as square, rectangular or hexagonal.

In another example, shown in FIG. 4, the members 46 are a plurality of axially extending pins or members that are cross-sectionally arrayed. Each member 46 is individually movable so that the shape and/or size of the cavity 30 can be adapted to at least partially conform to the size and/or shape of the engaged portion of the wellhead 20.

Figure 5:
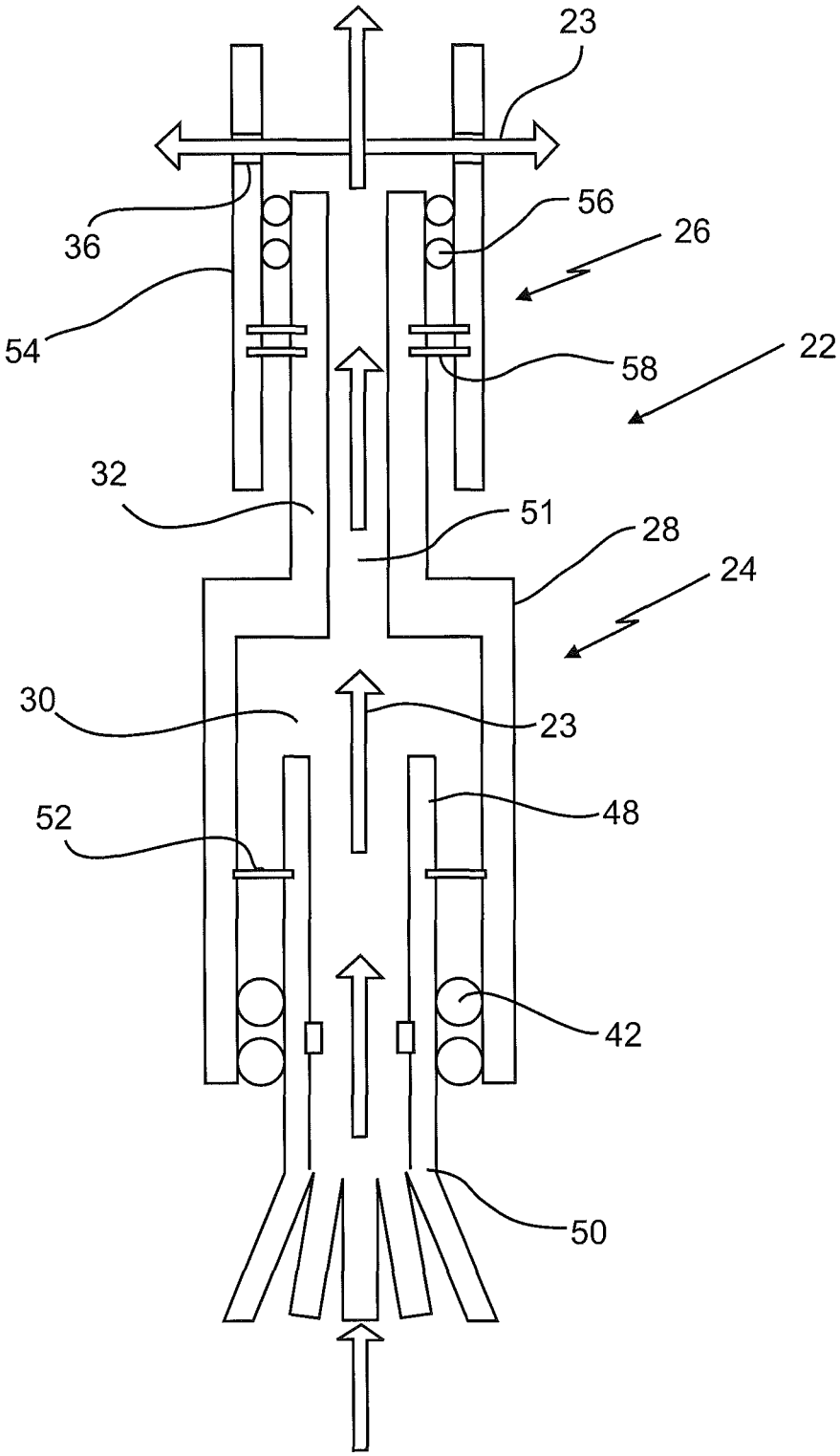
FIG. 5 is a side cross-sectional view of an embodiment of a borehole fluid containment/control device in an unengaged position.
Figure 6:
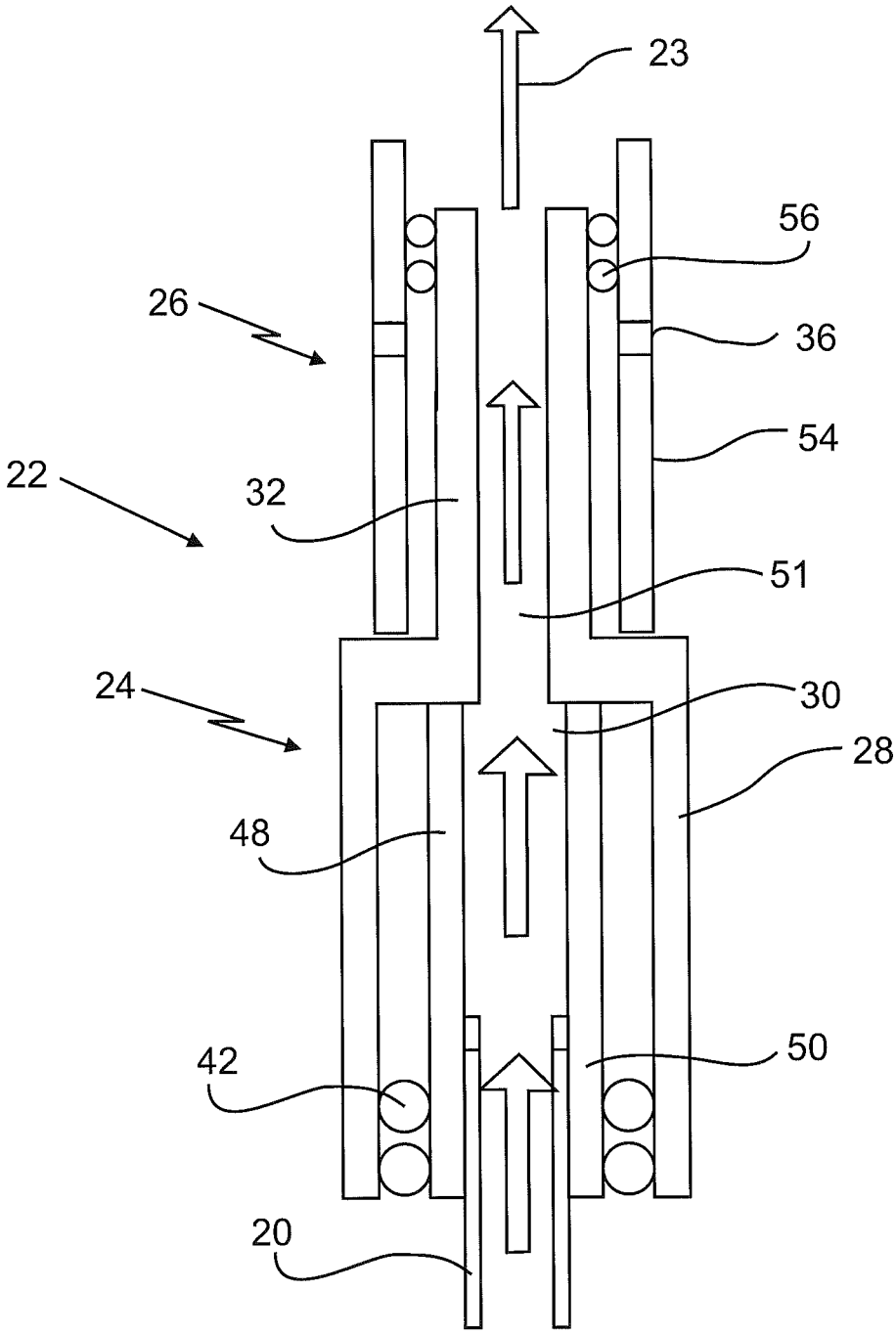
FIG. 6 is a side cross-sectional view of the borehole fluid containment/control device of FIG. 5 in an engaged position.

FIGS. 5 and 6 illustrate an example of the well capping device 22. The engagement assembly 24 and the flow control assembly 26 are each shown in an open, unengaged position in FIG. 5 and a closed, engaged position in FIG. 6. In this example, the well capping device 22 includes an engagement body 28 that is operably connected to an interior sleeve 48 including a collapsible sealing portion 50. In one embodiment, the engagement body 28 defines part of both the engagment assembly 24 and the flow control assembly 26. For example, in the engagement assembly 24, a first portion of the engagement body 28 has an internal diameter that is large enough to accommodate the interior sleeve 48, and a second portion of the body 28 has an internal diameter that defines a fluid flow conduit 51, and may be configured to generally correspond to the interior sleeve 48, the wellhead portion and/or other containment conduits or vessels that may be operably connected to the well capping device 22. Although the first portion and the second portion are shown in FIG. 5 as a single body, they could be multiple bodies attached to or otherwise in fluid communication with one another.

As shown in FIG. 5, in the open position, the interior sleeve 48 is positioned within the engagement body 28 so that the collapsible sealing portion 50 generally defines a cross-sectional area that is greater than the area or diameter of the wellhead portion so that the sealing portion 50 can be fitted over and around the wellhead portion.

As shown in FIG. 6, a force can be extorted on the engagement body 28 to actuate the engagement assembly 24 and cause the engagement body 28 to descend around and tighten the collapsible sealing portion 50 on the wellhead portion. In one embodiment, the collapsible sealing portion 50 is a tapered, beveled or otherwise radially extending portion that can be reduced in diameter by the engagement body 28. For example, the portion 50 includes a "feathered" flange including a plurality of radially outwardly splayed teeth or members that can be closed around the wellhead portion. The portion 50 may include various coatings or adhesives to facilitate gripping and/or sealing the wellhead portion.

In one embodiment, the engagement assembly 24 includes a mechanical release such as at least one shear pin 52 that releasably attaches the interior sleeve 48 to the engagement body 28. The shear pin 52 is configured to break at a selected shear force. In one embodiment, a sealing mechanism 42 such as one or more o-rings or other compressible gaskets is included between the engagement body 28 and the interior sleeve 48 to prevent fluid 23 from flowing out of the intended fluid path defined by the cavity 30 and the flow control assembly 26 during and after actuation.

In one embodiment, the inner diameter of the engagement body 28 and the outer diameter of the interior sleeve 48 each have a gap that may be filled with a sealing material, such as via an input port 44 to allow the collapsible sealing portion 50 to seal around the engaged wellhead portion, which can allow the collapsible portion 50 to form around a tubular wellhead component or a wellhead component that is no longer round as a result of, e.g., bending prior to being cut or breached.

In one embodiment, the flow control assembly 24 includes a containment sleeve 54 that includes the at least one port 36. A second sealing mechanism 56 such as one or more o-rings or other compressible gaskets is included between the body 28 and the containment sleeve 54 to prevent fluid 23 from flowing out of the intended fluid path defined by the conduit during and after actuation. In an open position, shown in FIG. 5, the containment sleeve 54 is positioned relative to the engagement body 28 so that the at least one port 36 is in fluid communication with the conduit 51 to allow fluid 23 to flow into the surrounding environment. In a closed position, shown in FIG. 6, the containment sleeve 54 is positioned relative to the body 28 so that the at least one port 36 is closed off from the conduit 51 so that fluid is restricted to the conduit 51 and may be directed to a remote location. The containment sleeve 54 is not restricted to the embodiments described herein. For example, the at least one port 36 may be located on the engagement body 28 and the containment sleeve 54 could be configured to be actuated to cover or otherwise close off the at least one port 36.

In one embodiment, the flow control assembly 26 includes a mechanical release such as at least one shear pin 58 that releasably attaches the containment sleeve 54 to the body 28 at the open position. The shear pin 58 is configured to break at a selected shear force so that the containment sleeve 54 can be moved axially to the closed position and the sealing mechanism 56 is disposed between the at least one port 36 and the conduit 51. In one embodiment, the shear pin 58 is configured to break at a greater force than the engagement assembly shear pin 52, so that the engagement assembly 24 can be actuated separately from the flow control assembly 26.

Although the body 28 and sleeves 48 and 54 are described in the above embodiments as being generally cylindrically, they are not so limited. The tool 30 and components thereof may form any suitable cross-sectional shape, for example, to accommodate the shapes of borehole openings due to deformities created by a blowout or other breach.

The particular shapes and diameters of the components of the well capping device 22 may be manufactured to accommodate a wide variety of well head components, BOPs and other borehole components that may experience a breach causing a fluid leak. In addition to being specifically manufactured for specific situations, components may be stocked in various sizes and shapes to allow for rapid assembly and deployment. For example, interior sleeves 48 may have various diameters and/or shapes/sizes of the sealing portions 38 to accommodate multiple leak situations. Furthermore, the components described herein, such as the flow control assembly 26, engagement body 28, connector 32, movable members may be made from any suitable material, such as steel, stainless steel, aluminum and various metal alloys. In one embodiment, the materials include materials able to withstand forces and pressure extorted by, for example, downhole fluid and/or undersea pressures.

Referring again to FIG. 1, the well capping device 22 may include or be associated with various tools that are used to measure conditions in or around the well capping device 22, such as fluid pressures and flow rates. Such measurements may be useful in coordinating actuation of the engagement assembly 24 and the containment assembly 26 and assessing the success of using the well capping device 22. Examples of such sensors include pressure sensors, vibration sensors, temperature sensors, flow rate sensors, gas content and/or mud composition sensors and others. In addition, the well capping device 22 may include a processing unit or be equipped with transmission equipment to communicate ultimately to a remote processing unit (e.g., an ocean surface unit in the case on an undersea borehole. Such transmission equipment may take any desired form, and different transmission media and connections may be used. Examples of connections include wired pipe, fiber optic and wireless connections.

In one embodiment, the remote processing unit and/or the well capping device 22 include components as necessary to provide for storing and/or processing data collected from the well capping device 22. Exemplary components include, without limitation, at least one processor, storage, memory, input devices, output devices and the like. The remote processing unit optionally is configured to control actuation of the well capping device 22.

Figure 7:
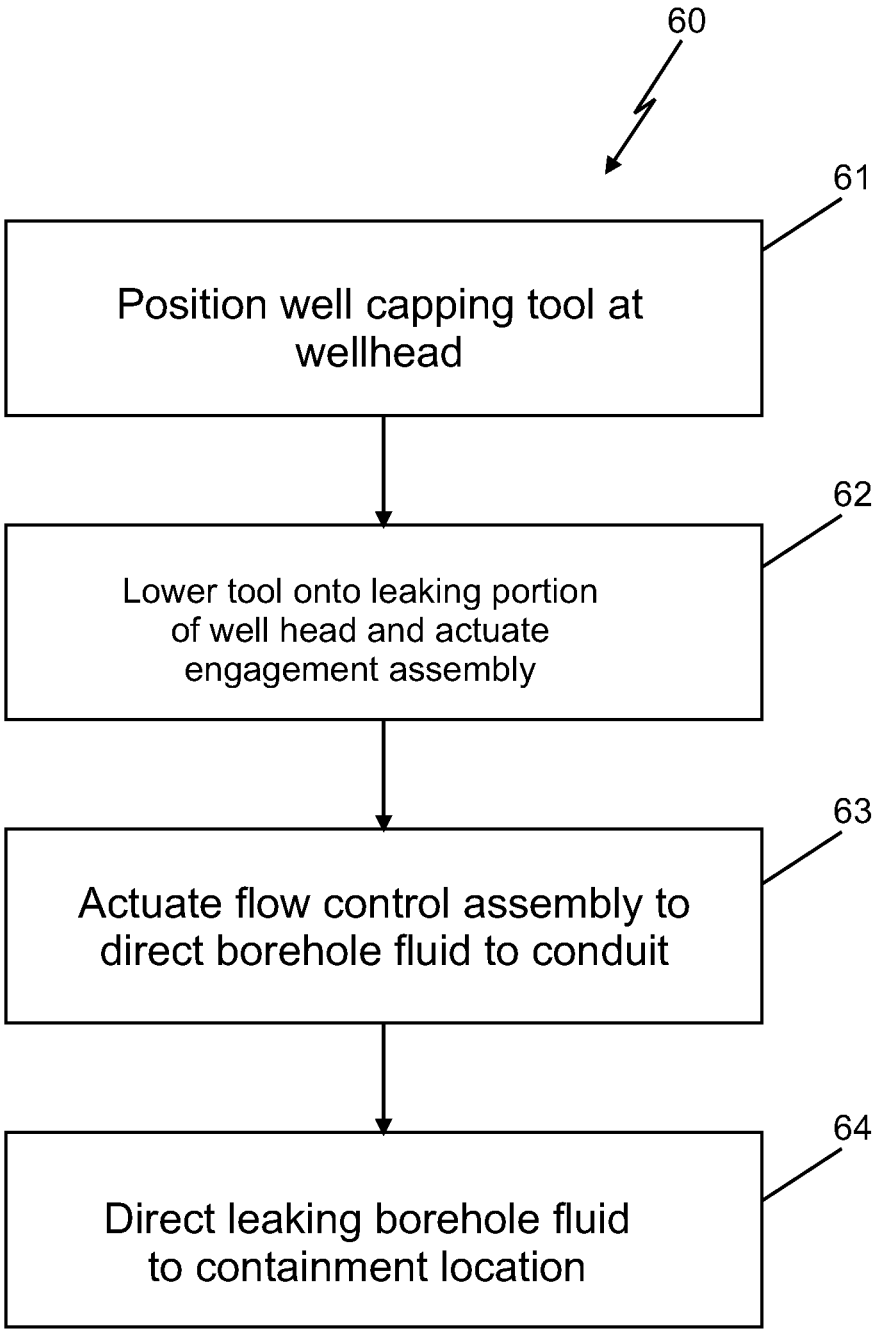
FIG. 7 is a flow chart providing an exemplary method of controlling fluid flow from a borehole.

FIG. 7 illustrates a method for containing fluid flow from a borehole. The method includes one or more of stages 61-64 described herein. The method may be performed manually or by one or more processors or other devices capable of receiving and processing measurement data, such as a remote processing unit. In one embodiment, the method includes the execution of all of stages 61-64 in the order described. However, certain stages 61-64 may be omitted, stages may be added, or the order of the stages changed.

In the first stage 61, the well capping device 22 is positioned at the wellhead 20. In one embodiment, the tool 22 is positioned so that the engagement assembly 24 is located proximate to the wellhead and/or the leaking portion of the wellhead 20.

In the second stage 62, the engagement assembly 24 is actuated by, for example, lowering the well capping device 22 so that at least a portion of the engagement body 28 surrounds at least the leaking portion of the wellhead 20. In one embodiment, lowering the well capping device 22 includes contacting one or more of the movable members 46 and retracting the contacted movable members 46 so that the cavity 30 at least partially conforms to the size and/or shape of the leaking portion and/or the wellhead 20.

In one embodiment, actuation includes lowering the well capping device 22 so that at least part of the collapsible portion 50 of the containment sleeve 48 surrounds the leaking portion, and exerting vertical pressure on the well capping device 22. The vertical pressure is sufficient to break the shear pins 52 or otherwise actuate the engagement assembly 24 to cause the engagement body 28 to slide over the collapsible portion 50 and form a friction fit between the leaking portion and the engagement assembly 24 that is at least partially or substantially fluid-tight. In one embodiment, at this stage, the flow control assembly 26 is in the open position and allows discharge of fluid from the at least one port 36 to provide a flow path for fluid when the engagement assembly 24 is being positioned and actuated.

In the third stage 63, the flow control assembly 24 is actuated to form a fluid flow path between the cavity 30 and the conduit 38 so that borehole fluid 23 can be directed away from the leaking portion and at least partially eliminated from the surrounding environment. In one embodiment, the fluid ports 36 are closed via, for example, the valves 40 or the shear pins 58 to prevent fluid from flowing into the environment and direct fluid flow to the conduit 38.

In the fourth stage 64, borehole fluid is directed from the well capping device 22 through the conduit 38 to a remote location. For example, the well capping device 22 may be connected in fluid communication via the flow control assembly 26 to a collection unit such as a tank or a tanker ship.

The above stages can be performed by an operator, positioned manually, and/or positioned and actuated remotely via a processing/control unit (such as the surface unit) at the surface of the earth or above water. In one embodiment, a robotic unit or remote operated vehicle (ROV) may be used to perform the stages in a subsea environment.

The apparatuses, systems and methods described herein provide various advantages over prior art techniques. The embodiments described herein offer the ability to quickly and effectively respond to blowouts or other failures to capture fluid flow to reduce or minimize the amount of fluid escaping from a borehole. The apparatuses, systems and methods have value in stopping losses of oil, production fluids and other material into the environment, stopping losses from a well and allowing control for a kill procedure, relief well or other remediation.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A device for containing fluid flow from a borehole, comprising:

a containment assembly including a body having a cavity configured to receive a leaking portion of a borehole termination structure extending from the borehole and surround the leaking portion, the cavity configured to be adapted to at least partially conform to a shape of at least one of the leaking portion and the borehole termination structure;

a flow control assembly configured to connect a fluid conduit in fluid communication with the containment assembly and direct downhole fluid into the fluid conduit; and at least one axially moveable member including a plurality of axially extending members configured to retract in response to engaging the containment assembly with the leaking portion and at least partially conform a cross-sectional shape of the cavity to the shape of at least one of the leaking portion and the borehole termination structure.

2. The device of claim 1, wherein the plurality of axially extending members includes a plurality of concentric axially extending members.

3. The device of claim 1, further comprising an engagement mechanism configured to be actuated to secure the containment assembly to the borehole termination structure.

4. The device of claim 3, wherein the engagement mechanism includes a deformable material disposed at the body and configured to form an at least partially fluid-tight seal between the body and the borehole termination structure.

5. The device of claim 4, wherein the deformable material includes at least one of an expandable material, an inflatable material, a foam material and a shape memory material.

6. The device of claim 1, further comprising an input port configured to inject a flowable sealing material into the cavity to form an at least partially fluid-tight seal between the body and the borehole termination structure.

7. The device of claim 1, further comprising at least one fluid port configured to direct the downhole fluid from the cavity to the surrounding environment, and configured to be closed after actuation of the engagement mechanism to direct the downhole fluid into the fluid conduit.

8. The device of claim 1, wherein the engagement mechanism includes a collapsible sealing portion configured to be actuated to collapse around at least the leaking portion and direct borehole fluid to the cavity.

9. The device of claim 1, wherein the borehole termination structure includes at least one of a wellhead and a blowout preventer.

10. A method for containing fluid flow from a borehole, the method comprising:

disposing a downhole fluid containment device proximate to a borehole termination structure from which borehole fluid is leaking into an ambient environment;

lowering the containment device so that a containment assembly receives at least a leaking portion of the borehole termination structure, the containment assembly including a body having a cavity configured to surround the leaking portion upon receiving the leaking portion;

adapting the cavity to at least partially conform to a shape of at least one of the leaking portion and the borehole termination structure, wherein adapting the cavity includes retracting at least one axially moveable member in response to engaging the containment assembly with the leaking portion to at least partially conform a cross-sectional shape of the cavity to the shape of at least one of the leaking portion and the borehole termination structure, the at least one of the axially moveable member including a plurality of axially extending members;

directing borehole fluid from the leaking portion through the hollow body to at least one discharge port in fluid communication with the ambient environment; and diverting the borehole fluid to a fluid conduit by connecting the fluid conduit in fluid communication with the containment assembly and closing the at least one discharge port.

11. The method of claim 10, wherein the at least one axially moveable member includes a plurality of concentric axially extending members.

12. The method of claim 10, further comprising actuating an engagement portion to secure the containment assembly to the borehole termination structure.

13. The method of claim 12, wherein actuating the engagement mechanism includes contacting a deformable material disposed at the body with the borehole termination structure to form an at least partially fluid-tight seal between the body and the borehole termination structure.

14. The method of claim 13, wherein the deformable material includes at least one of an expandable material, an inflatable material, a foam material and a shape memory material.

15. The method of claim 12, wherein actuating the engagement mechanism includes actuating a collapsible sealing portion to collapse around at least the leaking portion and direct borehole fluid to the cavity.

16. The method of claim 10, wherein the borehole termination structure includes at least one of a wellhead and a blowout preventer.

* * * * *